United States Patent [19]

Varga

[11] Patent Number: 4,895,011

[45] Date of Patent: Jan. 23, 1990

[54] CONTINUOUSLY BALANCED APPARATUS FOR STORING AND DISPENSING ELONGATE MATERIALS

[75] Inventor: Andre Varga, Willowdale, Canada

[73] Assignee: Ceeco Machinery Mfg. Co. Inc., Ltd., Concord, Canada

[21] Appl. No.: 325,641

[22] Filed: Mar. 20, 1989

[51] Int. Cl.[4] ..... B21C 37/12; B21C 47/00; B65H 20/24; B65H 20/26

[52] U.S. Cl. ..... 72/49; 72/66; 72/142; 72/146; 242/55

[58] Field of Search ..... 72/49, 50, 66, 135, 72/137, 142, 145, 146, 148; 228/17, 17.5, 17.7, 145–147; 242/55, 55.19 R

[56] References Cited

U.S. PATENT DOCUMENTS

| | | | |
|---|---|---|---|
| 3,258,212 | 6/1966 | La Tour | 242/55 |
| 3,506,210 | 4/1970 | La Tour et al. | 242/55.19 R |
| 3,628,742 | 12/1971 | Fritzsche | 242/55 |
| 3,888,430 | 6/1975 | Costello et al. | 242/55 |
| 4,092,007 | 5/1978 | Weatherby et al. | 242/55 |
| 4,163,527 | 8/1979 | Hood et al. | 242/55 |
| 4,505,438 | 3/1985 | Sendzimir et al. | 242/55 |
| 4,569,487 | 2/1986 | Sluzallek | 242/55 |
| 4,597,267 | 7/1986 | Legallais | 72/49 |
| 4,783,980 | 11/1988 | Varga | 72/49 |

FOREIGN PATENT DOCUMENTS

| | | | |
|---|---|---|---|
| 3430209 | 2/1986 | Fed. Rep. of Germany | 242/55 |
| 1010167 | 11/1965 | United Kingdom . | |

OTHER PUBLICATIONS

FLOOP Strip Accumulator, Kent Corporation, What is a Floop.

*Primary Examiner*—E. Michael Combs
*Attorney, Agent, or Firm*—Lilling & Greenspan

[57] ABSTRACT

An apparatus is described for storing and dispensing elongate flat strip material for use with rotating machinery, such as that used to produce helically wound interlocked flexible pipe. The strip material is fed from an external payoff or supply reel and guided by an inlet guide roller to feed the advancing strip tangentially onto a series of storage guide rollers which are spaced from each other about a circular path concentric with the machine axis. The strip is maintained under tension and is wound onto the storage guide rollers to provide a reservoir of strip material arranged in a single row of substantially circular overlappping convolutions concentrically arranged about the machine axis. A roller is used to monitor the amount of strip material which remains stored on the rotating support member, and the rotation of the latter is terminated when the stored strip material is depleted or is about to be depleted, to allow an operator to attach the trailing end of the depleted stored strip with the leading end of a next successive strip material to be wound onto the storage guide rollers. The arrangement of the storage guide rollers insures a balanced condition of the rotating machine irrespective of the amount of strip material which remains stored.

22 Claims, 4 Drawing Sheets

CONTINUOUSLY BALANCED APPARATUS FOR STORING AND DISPENSING ELONGATE MATERIALS

BACKGROUND OF THE INVENTION

1. Field of the Invention

This invention generally relates to machinery for handling elongate materials, and more specifically to a continuously balanced apparatus for storing and dispensing elongate materials.

2. Description of the Prior Art

It is frequently required during manufacture to utilize machinery which must be supplied with elongate materials from pay off devices, such as reels or bobbins or, in some instances, in relatively flat packages sometimes referred to as "flat pancake" packages, in which a flat strip of material is wound as a single row consisting of a series of overlapping convolutions. However the capacity of such packages is limited. Additionally, such packages are available from a large number of suppliers. Therefore, in many instances, the packages are not compatible or immediately mountable on the machinery being used and, therefore, the packages must first be rewound or otherwise arranged to be usable with the machinery. Such rewinding normally involves down time of the machinery thereby resulting in a loss of output and operating efficiency.

Numerous attempts have been made to overcome the problems of feeding continuous elongate materials. For example, strip accumulators have been proposed which allows strip to be fed into the accumulator at a speed faster than the strip is removed for processing, thereby causing excess strip to be stored within the accumulator. In this manner, processing can continue by utilizing the stored strip while the lead end of a new coil is welded to the end of the last coil to be fed to the accumulator. However, such strip accumulators are typically stationary and, therefore, the use of the stored strip in conjunction with rotating machinery may present difficulties, including multiple twists or bends of the strip material as it is fed to the processing zone of the machine.

An attempt to supply rotating machinery with a supply of strip material is disclosed is U.S. Pat. No. 4,597,276, wherein a supply reel in the nature of a "pancake" package is mounted on a rotating head or support plate, the end of the strip being guided by rollers mounted on the rotating plate and fed to a central zone along the axis of the rotating machine where the strip is helically wound to manufacture interlocked tubular pipe. In the aforementioned patent, the strip material must first be wound on the reel, which is adapted to be mounted on the rotating support plate. The reels which are mounted on the rotating support plate are typically wound in a separate operation prior to mounting on the support plate. Once mounted on the rotating plate, the machinery can operate continuously until the reel is empty, at which time the machine must be stopped, the reel rewound in a separate operation or the reel must be replaced with another similar reel which has been prepared for this purpose. Additionally, in order to attach the end of a first strip to the beginning end of a new strip, the ends of the respective strips must be welded or otherwise attached to each other. A major disadvantage with the approach disclosed in this patent is that the reel is mounted eccentrically or spaced from the machine axis of rotation of the rotating plate, thereby presenting an unbalanced condition which can become intolerable unless compensated with appropriate counterweight measures. However, because the weight of the reel changes continuously as it is emptied and the strip is consumed, the extent of unbalance also changes continuously during the operation of the machine, which makes it more difficult to compensate for the weight of the reel and provide the proper balance during the entire unwinding operation. The patent does not disclose any counterbalance or counterweight measures, and to provide perfect compensation and rotational stability of the rotating head during the entire work cycle of the reel would be both complex and expensive. The off balance conditions represented by the patent design also limits the amount of strip material that can be mounted on the rotating plate, and irrespective of the number of reels that can be mounted on the machine, the almost certain imbalances which will result limit the usefulness of the design.

In British Patent No. 1,010,167, a machine is disclosed for the helical winding of tapes and the like. The apparatus disclosed in the patent is an attempt to provide a reservoir of strip-type material on a rotating machine which allows for the connection of the end of a first strip to the beginning of a new strip without interruption of the operation of the machine, so that the rotating machine may enjoy the same advantages as those involved with stationary strip accumulators. The machine disclosed in this patent includes a fixed support on which there is wound tape or strip material from a feed roller spool to form concentric revolutions or turns on a set of rollers carried by a rotatably mounted annular plate. The inner turns of the so formed helical arrangement are dispensed and wound onto a mandrel in the central region of the rotating annular plate. The rollers are so mounted on the annular plate as to be movable towards a fictitious center in order to permit the variation of the perimeter of a polygon which is defined by the points where the rollers are mounted and along which the different concentric convolutions of the tape are formed. The rollers are caused to move outwardly during normal operation to keep the tape under constant mechanical tension. When the feed roller spool is exhausted, the rollers are adapted to move inwardly, during continued rotation of the annular plate, to compensate for the fixing of the position of the free end of the tape while it is connected to the leading end of a fresh roll or spool. The intention of the apparatus disclosed in the British patent is to allow a fresh spool to be connected to the end of a strip which had been stored on the rotating plate without stopping the machine. However, the arrangement proposed in the British patent has a number of disadvantages. The change in diameter or dimensions of the polygon as a result of the inward movement of the rollers is relatively small compared to the average diameter defined by the rollers on the supporting annular plate. Therefore, when the end of the strip is gripped and fixed in position for the purpose of attachment to a new supply reel, the continued rotation of the annular plate causes a rapid change in the capacity or amount of wire stored on the rollers. The inward movement of the rollers only compensates for a part of that depletion and, since the stored or cumulative capacity to give up wire is a function of the change in the diameter of the stored loop as well as the number of turns, a large number of turns must normally be used to provide the requisite cumulative capacity required during the strip attachment cycle. However, as the number of turns is increased, the system is more prone to locking up or freezing once the ends are joined and a strip from a new supply is fed to the apparatus for restoring or replenishing the reservoir of wire on the rollers. Any effort to increase the diameter about which the rollers are mounted in order to increase the cumulative capacity, in an effort to reduce the number of turns, aggravates the condition because the amount of wire depleted during each turn of the annular plate increases once the end of the strip is fixed in position. Therefore, any attempt to increase the cumulative capacity by increasing the radius of the rollers or increasing the number of turns stored on the rollers would create difficulties and make the machine inoperative. As suggested, the problem with the machine disclosed in the British patent is that it attempts to provide a continuous helical winding of a tape or strip without ever stopping the machine, which necessitates the periodic gripping and fixing the position of a trailing strip end for the purpose of attachment to a next successive supply reel.

In the case of heavier or thicker strip materials, such as stainless steel strip, it has, in some cases, been required to transfer the strip from its payoff device with a number of twists from the plane of the strip. It is usually preferred that such twists be minimized or eliminated, as are bends of the strips about small diameter in order to minimize friction and damage to the strip. For example, in U.S. Pat. No. 4,783,980, issued to Ceeco Machinery Manufacturing Limited, the assignee of the instant application, an apparatus is disclosed for making helically wound interlocked flexible pipe. Two supply reels or dummy spools are provided one of which is active to supply strip material to produce the pipe while the other is loaded with strip material from external flat pancake reels to serve as a substantial reservoir of strip material which takes over when the active reel gives up all of its strip material. Since rewinding can be effected at a higher speed than the normal dispensing speed of the machine, the rewound bobbin can be filed from a number of flat pancakes, suitably joined before it is time to switch dummy spools. Rewinding of an empty dummy spool does not result in down time because the procedure does not interfere with the dispensing of the strip material from the other, active spool. However, in order to refill the dummy spools and dispense the strip material, it passes over a number of pullies or rollers and is twisted a number of times out of its plane. While this may be acceptable for most strip materials, the disclosed arrangement becomes impractical for larger dimensioned strip materials used to produce flexible pipe needed to withstand ever increasing pressures.

SUMMARY OF THE INVENTION

It is, accordingly, an object of the present invention to provide an apparatus for storing and dispensing continuous materials which overcomes the disadvantages inherent in prior art comparable devices.

It is another object of the present invention to provide an apparatus of the type under discussion which minimizes or eliminates down time due to rewinding of pay off devices, such as reels or bobbins, onto the apparatus which stores and dispenses the elongate material.

It is another object of the present invention to provide an apparatus as in the aforementioned objects which remains balanced throughout the entire storage and dispensing procedure, irrespective of how much elongate material has been stored or dispensed.

It is yet another object of the present invention to provide an apparatus of the type suggested in the previous objects, which assures proper tensioning of the loop material both during storage and dispensing, so that the loop material remains concentrically arranged about the axis of the rotating machine, thereby avoiding imbalance and assuring good quality of the material being produced.

It is a further object of the present invention to provide a continuously balanced apparatus for storing and dispensing elongated materials which has application in numerous and diverse arts, including, but not limited to, the field of producing helically wound interlocked flexible pipe.

It is still a further object of the present invention to provide an apparatus of the type referred to in the last object, which is practical and usable with strip material of various types, including large dimensioned stainless steel strip material which can be processed with minimal and, preferably, no twists from the plane of the strip or bends about small diameter rollers.

In order to achieve the above objects, as well as others which will become apparent hereafter, a continuously balanced apparatus for storing and dispensing elongate materials in accordance with the present invention, for use with a rotating machine having a machine axis, comprises a support member mounted for rotation about the machine axis. Inlet guide means are provided for guiding elongate material from an external supply to said support member. Storage guide means is mounted on said support member which serves as a reservoir for storing elongate material as a single row of substantially circular overlapping convolutions concentrically arranged in relation to said machine axis. Outlet guide means, mounted on the support member, is provided for guiding the innermost convolution of said storage guide means radially inwardly of the support member proximate to said machine axis for being dispensed to a manufacturing operation. Tension means is provided for maintaining a tension on the elongate material, and sensing means is provided for sensing when elongate material is about to be depleted from said reservoir storage guide means to stop the rotation of said support member and allow attachment of the end of a stored length of elongate material to the beginning end of a new supply of elongate material to be wound on said storage guide means.

In order to prevent uncontrolled movements of the trailing end of a length of elongate material, once it has been fully wound onto said storage guide means, and to place the wound material under tension end securing means is advantageously provided for restraining said trailing end during the continued rotation of the machinery until such time that the trailing end is attached, such as by welding, to the initial end of a subsequent length of elongate material to be wound onto said storage guide means.

The apparatus in accordance with the present invention can find applications with numerous rotating machinery. An important application for the invention, disclosed herein, is its use in connection with, for example, a machine for making helically wound interlocked flexible pipe manufactured from elongate steel strip material.

BRIEF DESCRIPTION OF THE DRAWINGS

The objects and advantages of the present invention will become apparent from the following drawings taken together with the accompanying description, which show for purposes of illustration only presently preferred embodiments of the invention, wherein:

FIG. 5 is a cross-sectional view of the rope deflector roller shown in FIG. 3, taken along line 5—5;

DESCRIPTION OF THE PREFERRED EMBODIMENTS

Figure 1:
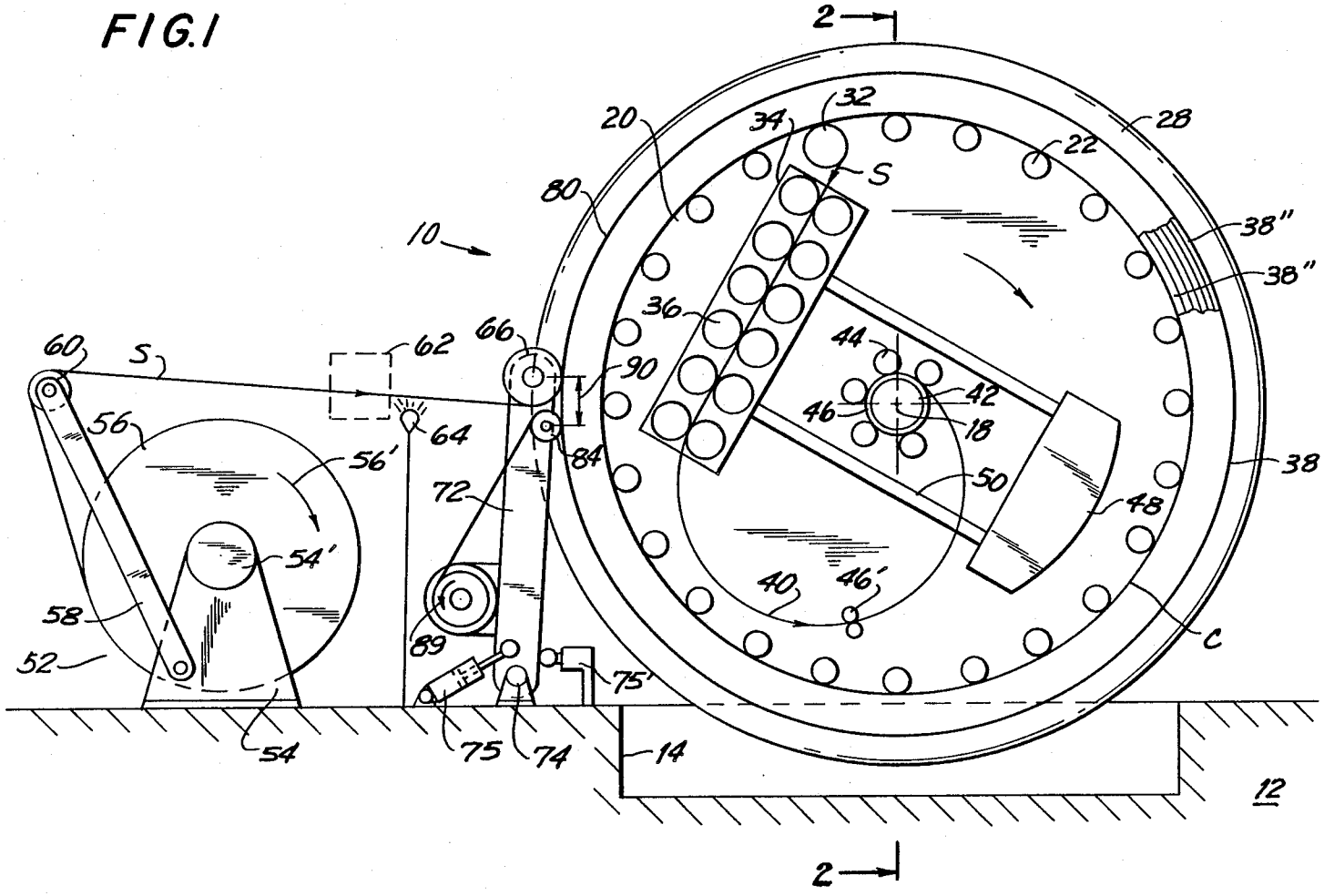
FIG. 1 is a front elevational view of the apparatus in accordance with the present invention, shown partially diagrammatically.
Figure 2:
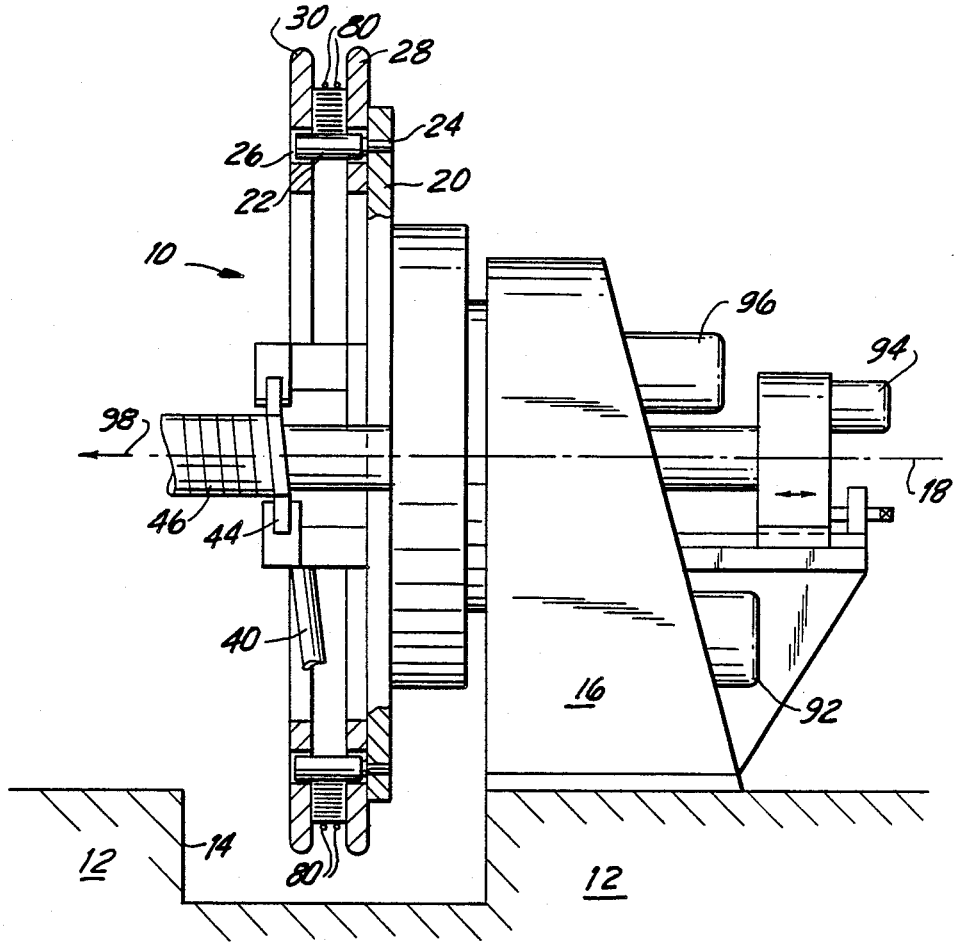
FIG. 2 is a side elevational view of the apparatus shown in FIG. 1, shown partially along a cross section taken along line 2—2 in FIG. 1.
Figure 2:
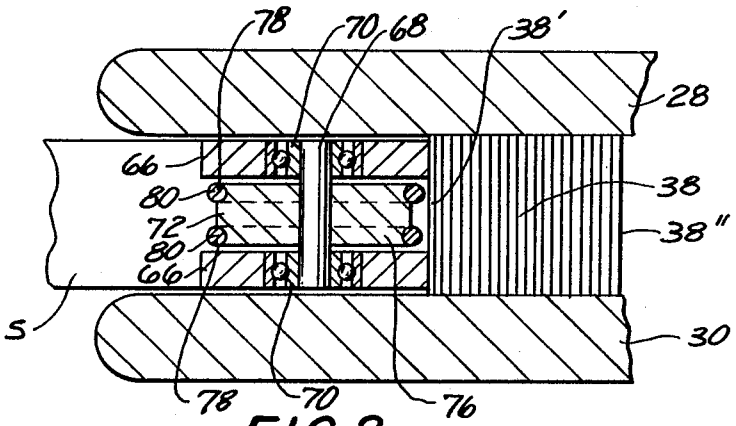
Figure 4:
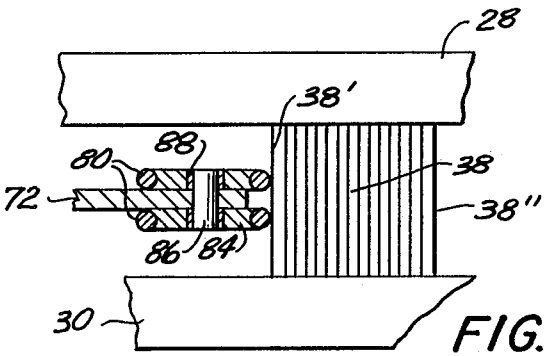
FIG. 4 is a cross-sectional view of the input guide roller shown in FIG. 3, taken along line 4—4.

Referring now specifically to the figures, in which identical or similar parts are designated by the same reference numerals throughout, and first referring to FIGS. 1 and 2, a machine for making helically wound interlocked flexible pipe is generally designated by the reference numeral 10. The machine is in many respects identical to the machine disclosed in U.S. Pat. No. 4,783,980 issued to Ceeco Machinery Manufacturing Limited, and reference is made to the aforementioned patent for description of structure and operation which is common to the two machines, to avoid repetition herein.

The machine 10 is mounted on a concrete foundation 12 which is provided with a recess or opening 14. Supported on the foundation 12 is a stationery support 16 that supports the machine 10, which defines a machine axis 18. Both machines are used to manufacture helically wound interlocked flexible pipe. However, the description that follows of a machine of the type aforementioned is only by way of example, since it will become readily apparent that the structure for storing and dispensing elongate material in accordance with the invention can be used with any rotating machine which requires a system for winding, from external payoffs, a supply of elongate material for storage, such as flat strip material, onto the rotating machine to provide a continuously balanced system at all stages of operation.

A support member 20 in the form of a rotating head or circular plate is mounted on the machine 10 for rotation about the machine axis 18. A plurality of storage guide rollers 22 are spaced from each other about a circular path C concentric with the machine axis 18. The rollers 22, as will become evident from the description that follows, are adapted to support a reservoir of elongate material as a single row of substantially circular overlapping convolutions concentrically arranged in relation to the machine axis 18. While the diameter of the concentric circular path C is not critical, in the context of the environment being described, namely a machine for making helically wound interlocked flexible pipe, the diameter should be selected to define a sufficiently large central or interior working area for mounting various structures more specifically described in U.S. Pat. No. 4,783,980. The diameter of the circular path C must also take into account the amount of elongate material that is to be stored or the size of the "reservoir" which is to be stored on the rollers 22.

While it will be evident to those skilled in the art that the apparatus of the present invention may be utilized with elongate materials having a different cross-sectional configurations, the embodiments that will be described, in the context of the use of the machine 10, will consider elongate flat strip material, such as stainless steel, utilized in the manufacture of helically wound interlocked flexible pipe.

Referring to FIG. 2, the storage guide rollers 22 are mounted on the support member or rotating head 20, by any conventional attachment members 24, so that the axes of rotation of the rollers 22 are normal to the plane of the support member 20 and parallel to the machine axis 18. An important feature of the present invention is the rapid winding of a length of elongate material onto the storage guide rollers 22 to form a reservoir on the rotating support member 20 which can then be dispensed at a generally lower speed during a manufacturing operation. In the embodiment being described, the flat strip material S is wound onto the storage guide rollers 22 as a single row of substantially circular overlapping convolutions concentrically arranged in relation to the machine axis 18. In order to insure that the row of such turns, loops, or convolutions remain in one row as shown in FIG. 2, there is advantageously provided an inner flange 28 and an outer flange 30, mounted on the support member 20 for rotation therewith. The flanges can be axially fixed in relation to each other, so that the spacing there between substantially corresponds to the width of the strip material S. Although not shown, it will also be evident that one or both of the flanges 28, 30 may be also be mounted for movements in the axial direction relative to each other to increase or decrease the spacing between the flanges, thereby accommodating different widths of strip material.

Referring to FIG. 1, arranged within the circular path C is an outlet guide roller 32 for guiding the innermost convolution 38' on the storage guide rollers 22 and directing the strip material S radially inwardly. Generally, the strip material S, after it leaves the storage area 38 defined by the storage guide rollers 22 is directed inwardly proximate to the machine axis 18 where the strip is dispensed in a manufacturing operation. Although the diameters of the storage guide rollers 22 and the outlet guide roller 32 are not critical, the outlet guide roller 32 as shown may have a larger diameter than the diameter of the storage guide rollers 22 since the outlet guide roller 32 deflects or redirects the strip in a different direction and, therefore, bends the strip, while no such bending takes place at the storage guide rollers 22 each of which is only tangentially in contact with one line of the strip material. Particularly with a large dimensioned, stiff strip materials, such as stainless steel, the diameter of the outlet guide roller 32 is advantageously as large as possible to minimize extreme bends of the material which may impart undesired curvatures or otherwise stress the material.

Downstream of the outlet guide roller 32 is a tool head assembly 34, mounted for rotation with the support member 20 which, in the embodiment shown, is in the form of a series of six pairs of forming or shaping rollers 36 which impart a desired cross section to the flat strip in preparation for closing during the formation of the interlocked flexible pipe, as more fully explained in U.S. Pat. No. 4,783,980. After the strip has been shaped by the tool head assembly 34, it is formed into a loop 40, the size of which is monitored by sensing dancer rollers 46', which determine the speed of rotation of the forming or shaping rollers 36. This feedback arrangement assures that there is always an adequate supply of formed strip which can be formed on a mandrel 42 by free rolling pressure rollers 44 to produce the interlocked flexible pipe 46. The loop 40, therefore, also serves as a reservoir of formed strip material downstream of the tool head assembly 34, while the flat strip material S wound on the storage guide rollers 22 serve as a reservoir 38 of such material upstream of the tool head assembly 34. Both of these reservoirs, in this embodiment, are mounted on and rotate with the rotation of the support member 20. In order to insure a balanced condition, a counterweight 48 is mounted, by means of support members 50, on the diametrically opposite side of the tool head assembly 34. Since the tool head assembly is invariable in terms of its mass, the counterweight 48 can be selected to provide a balanced condition of the support member 20 at all operating speeds.

Referring to FIG. 1, the machine 10 supplied by a payoff device generally identified by the reference numeral 52, which includes a fixed support 54 mounted on the foundation 12 and a shaft 54', which has an axis parallel to the machine axis 18, although this is not a critical feature of the invention. Mounted on the shaft 54' is a bobbin or reel 56 which may be in the form of a "flat pancake" package of flat strip material. The package 56 is mounted for rotation, in the direction of the arrow 56' to dispense strip material S as shown. To control the unwinding of the bobbin or reel 56, there is advantageously provided a dancer mechanism 58 pivotally mounted at one end and provided with a roller 60 at the other end adapted to monitor the tension in the Strip S in a well known manner.

The dancer 58 may also be used to provide a braking tension to the strips thereby keeping the tension constant, irrespective of the size of the package 56 or how much strip material remains on that package. Additionally, as is also known, the dancer 58 may be used to provide full braking to the package 56 and deactivation of the rotating machine 10 in the event that the tension in the strip decreases rapidly as when the strip breaks or the package 56 becomes empty.

Provided downstream of the payoff mechanism 52 is a welding station or zone 62, of any conventional type, for attaching the end of an elongate length of strip material with the beginning end of a next succeeding length in order to provide a continuous strip of material. A lubricator 64 is shown downstream of the welding zone 62 for applying lubrication to at least one side of the strip material. The specific location of the lubricator 64 and/or its specific nature is not critical, but is intended to lubricate the strip material to minimize friction between adjacent convolutions of the strip when stored on the storage guide rollers 22. This lubrication may also be useful in the manufacturing process, such as the formation of the interlocked flexible pipe 46 in the embodiment being described.

Figure 3:
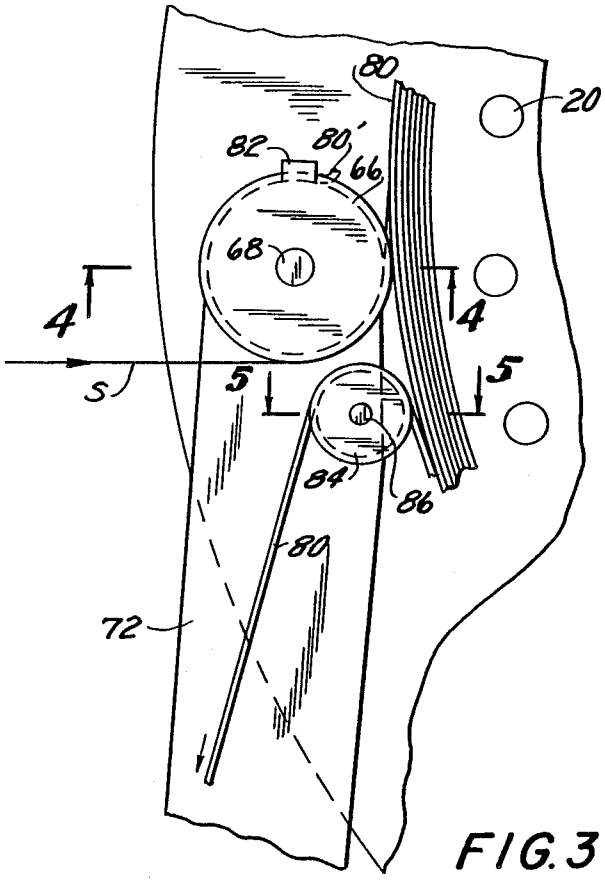
FIG. 3 is an enlarged view, partially fragmented, of the strip guide roller and rope assembly shown in FIG. 1.

An inlet guide roller 66 is provided proximate to the support member 20 for guiding the elongate strip material from the external supply or payoff device 52. As with the outlet guide roller 32, the diameter of the inlet guide roller 66 is advantageously made sufficiently large so as to minimize bending of the strip material S when same is redirected along a path parallel to tangential directions taken along the various individual loops, turns or convolutions 38 formed on the storage guide rollers 22. Referring to FIG. 3, the inlet guide roller 66 is mounted on a shaft or pin 68 supporting a bearing 70 on a pivoting arm 72 which, as shown on FIG. 1, is pivotally mounted about a pivot pin 74 for movements of the inlet guide roller 66 in directions towards and away from the storage guide rollers 22. A pneumatic piston 75 serves as a biasing device for urging the pivoting arm 72 and, therefore, the inlet guide roller 66, in the direction towards the storage guide rollers 22. However, any other biasing device, such as spring, could be used. Therefore, when the winding operation of an elongate strip of material commences, and a first convolution 38' is applied, the inlet guide roller 66 is located at the rightmost position, as viewed in FIG. 1, where the inlet guide roller 66 is the closest to the machine axis 18. With additional convolutions wound on the storage guide rollers 22, the roller 66 is urged outwardly, to the left in FIG. 1, as the roller engages the outer convolution 38'' which is further and further radially spaced from the machine axis 18 as the number of layers or turns increases or builds up.

A suitable sensor, in the form of a microswitch 75' cooperates with the pivoting arm 72 to sense when the inlet guide roller 66 abuts against only one or a few convolutions or turns remaining on the storage guide rollers 22, signifying that the storage of strip material has almost become exhausted. The switch 75' is connected to appropriate controls for terminating the rotation of the support member 20 before the strip stored on the rollers 22 is fully exhausted, thereby permitting an operator to attach the end of the stored strip to the beginning end of the next succeeding strip to be wound, by attachment of the respective ends to each other at the welding zone 62. Other known sensing and control mechanisms may be used to terminate the rotation of the rotating head when the strip becomes exhausted.

Figure 6:
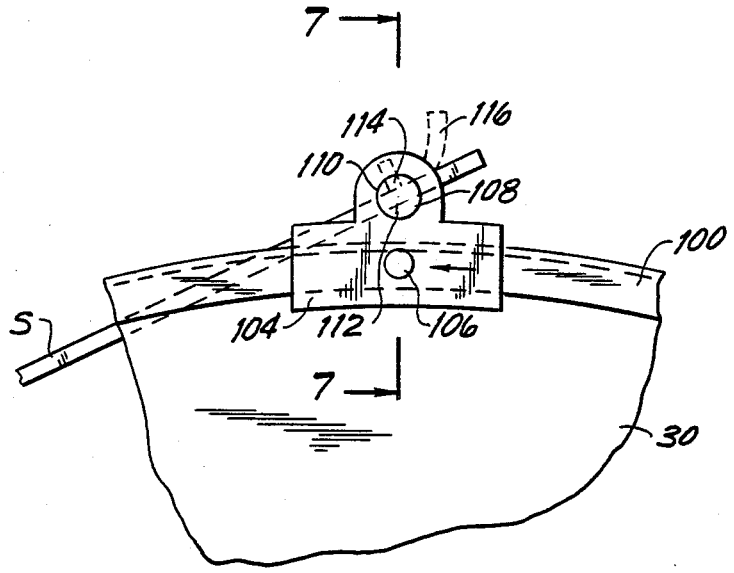
FIG. 6 is a side elevational view of an alternate construction to secure the strip end in place of the rope brake system illustrated in FIGS. 3–5.
Figure 7:
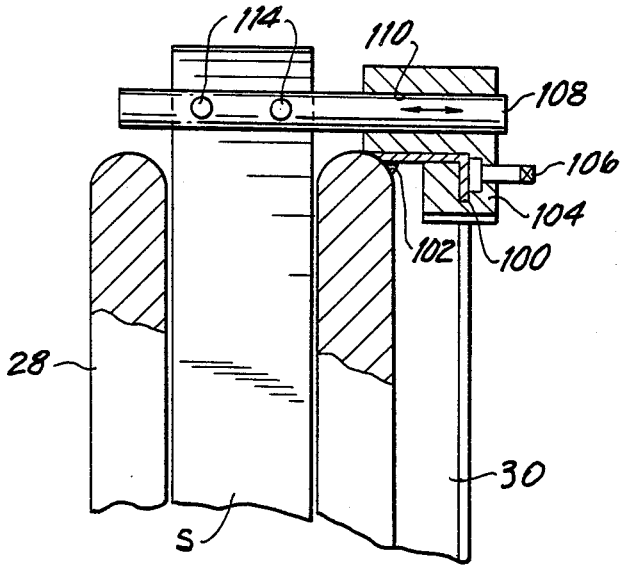
FIG. 7 is a side elevational view of the arrangement shown in FIG. 6, shown partly in cross section along a line 7—7 in FIG. 6.

The present invention contemplates, as above noted, the termination of rotation of the head or support member 20 at such time as a previously stored strip has been exhausted or is about to be exhausted from the reservoir represented by the turns, loops or convolutions 38. However, during the period that such continuous strip is stored on the storage guide rollers 22, the end of the strip would normally be free and, therefore, not under tension. Because such untensioned free-end may present problems in having the end flop around uncontrollably and such absence of tension on the end of the strip may result in the loosening and drooping of the package, the present invention also contemplates the application of tension to the strip in order to maintain uniform concentricity about the machine axis 18 and to insure better efficiency of operation and quality of resulting product. While numerous approaches may be used for applying tension to the stored strip, two specific arrangements will now be described, the first arrangement being shown in FIGS. 1–5 while the second is shown in FIGS. 6 and 7.

Referring first to FIGS. 1–5, the first tensioning arrangement includes a rope anchor or hub 76 fixedly mounted on the pivoting arm 72 and arranged between two inlet guide rollers 66. The hub 76 is mounted on the pivoting arm 72 provided with two annular recesses or grooves 78 which are spaced from each other as shown and dimensioned to receive ropes 80. As best shown in the FIGS. 3 and 4, the ropes have one of their free ends securely attached to the stationary hub 76 by means of rope clamps 82. From the position that the rope ends are clamped, the ropes extend about the substantial circumferential periphery of the hub 76 and extend tangentially along the arc of the outermost convolution, loop or turn 38''. As best shown in FIG. 1, the ropes 80 overlie the outer convolution 38'' substantially about the entire circumferential length thereof and return to the region of the inlet guide rollers 66. In the embodiment shown, an additional rope deflector roller 84 is provided in close proximity to the input guide roller 66 for receiving the ropes 80, again from a direction tangential to the outer convolution 38'' as shown, and deflected in a direction towards a rope tensioning device. While the nature of the rope tensioning device is not critical, and may simply consist of a weight or pneumatic cylinder arrangement connected to the downstream end of the rope 80 after it comes off of the rope deflector roller 84, the rope tensioning device shown in FIG. 1 is a motorized rope tensioner 89 of the type well known to those skilled in the art.

The rope deflector roller 84 is likewise mounted on the pivoting arm 72 by means of a shaft 86 and bushings 88. It will be appreciated that the rope deflector roller 84 rotates to a minimal extent and only when the length of the rope changes to compensate for changes in the outer diameter of the stored strip material package, rotating in a clockwise direction, as viewed in FIG. 1, when the stored package increases in diameter, and in a counter clockwise direction when the number of convolutions decreases because the strip material becomes depleted.

By applying a tension to the ropes 80 at the downstream end of the rope deflector roller 84, it will be appreciated that the ropes 80 will apply a drag on the outermost convolution or turn 38'', thereby applying a tension to the strip which is necessary to prevent loosening of adjacent turns and drooping of the package.

Referring to FIG. 1, the spacing 90 between the inlet guide rollers 66 and the rope deflector roller 84 is advantageously maintained at a minimum and, preferably, eliminated. While the free, trailing end of the strip is normally confined below the ropes 80, such end becomes unrestrained while it passes through the zone represented by the space 90 which does not provide rope contact. The greater the distance 90, therefore, the greater the time that the trailing free end of the strip is unrestrained and can move uncontrollably to thereby possibly cause damage to the strip itself and/or to the ropes 80 once it is again forced into contact with the ropes. By offsetting the rollers 66 and 84 along the direction of the machine axis 18, it is possible to move these rollers closer to each other, overlap or even pass each other along the circumferential direction to substantially eliminate the distance 90. It is not, however, necessary to totally eliminate this distance and the maintenance of a small distance 90 should be acceptable for most purposes.

Referring to FIG. 2, there is shown a main drive 92 for driving the support member or rotating head 20, a mandrel drive 94 for driving the mandrel upon which the pipe 46 is wound, and a forming roller drive 96 for driving the forming or shaping rollers 36. These drives are more fully described in U.S. Pat. No. 4,783,980.

Referring to FIGS. 6 and 7, the second tensioning arrangement is illustrated, which includes a ring 100, having an L-shaped cross section as shown, which is welded about its periphery to the flange 30 by means of a weld seam 102. Slidably mounted on the ring 100 is a shoe 104 which is provided with an internal opening configurated and dimensioned to receive the ring 100 for sliding movement along the ring. Although, depending upon the relative dimensions involved, the ring may be loosely fitted or may be frictionally fitted onto the ring 100, those skilled in the art will be in a position to determine the looseness of fit desired for any particular given design. In the event that sufficient friction is not exhibited by the arrangement described, there may also be provided a brake tension adjustment device 106, which may be in the form of a screw biased pad for applying additional frictional forces between the sliding shoe 104 and the ring 100.

Mounted on the sliding shoe 104 is a retractable strip anchor bar or pin 108 received through openings 110 in the sliding shoe 104. The bar or pin 108 is provided with a slot 112 dimensioned to receive the strip material 38 and secure the strip, normally the trailing end thereof, to the bar or pin 108 by means of strip gripping devices 114 which may be in the form of clamps or screws. In the alternative, the trailing end of the strip may be bent as suggested at 116 for engaging the bar or pin without the need for additional securing members. The shoe 104 need not be slidably mounted and could be mounted on rollers, for example. Also, an arm can be provided which rotates around the machine axis 108, frictional engagement being provided by a friction pad between the arm and the flange, as disclosed in U.S. Pat. No. 4,783,980.

For the arrangement shown in FIGS. 6 and 7, tension is applied to the strip only after it has been fully wound onto the storage guide rollers 22. Suitable sensing means (not shown) may be provided to establish when the trailing end of an elongate strip of material has reached or is about to reach the stored package 38. At this time, the bar or pin 108, which had been retracted (moved towards the right as viewed in FIG. 7) to permit free winding of the strips onto the reservoir guide rollers 22, is moved towards the left to bridge the flanges 28, 30 to the position as shown in FIG. 7. At that time, the trailing end is secured to the bar or pin 108 in any desired manner. The operation of the machine can now again be commenced, the trailing end of the strip having a tension applied thereto as a result of the frictional engagement between the sliding shoe 104 and the ring 100.

It will be appreciated that the use of the ropes (FIGS. 1–5) and the use of the ring 100 and sliding shoe 104 are separate approaches and only one need be used. The use of the ropes, however, has the additional benefits that tension is applied throughout the entire winding operation and does not commence only after the winding operation has terminated as is the case with the arrangement shown in FIGS. 6 and 7. Additionally, the use of the ropes has the added advantage that the machine need not be stopped only for the purpose to attach the end of the strip to the bar 110. Therefore, while the tensioning arrangement shown on FIGS. 1–5 appears to be preferable for most purposes, other arrangements may be used with different degrees of advantage.

In operation, a fresh payoff reel or bobbin 52 has the leading free end thereof guided past rollers 60 and 66 and placed between the storage guide rollers 22 and the ropes 80. The drive for the rotating head 20 can now be energized and the first loop, turn or convolution 38' is wound onto the storage guide rollers 22. Because the diameter of the concentric path C is typically substantially greater than the diameter of the bobbin or reel 56, the winding of the strip material takes place within a relatively short period of time and there is a rapid buildup of the strip to form a reservoir 38 of strip material having an inner most convolution 38' and outermost convolution 38''. While there is some relative circumferential movements between adjacent turns or convolutions in the package 38, such relative movements are minimal and friction has been found to be very small when smooth strip materials are used such as stainless steel. Such friction is further minimized by the use of the lubricator 64.

Once the entire length of strip material has been transferred to the reservoir 38, the support member 20 continues to rotate, dispensing the strip material via the loop 40 as described in the previous U.S. Pat. No. 4,783,980, the dispensing of the strip being at a significantly lower rate than the speed at which the strip is wound and stored into the reservoir 38.

When the reservoir 38 has been depleted or almost depleted, the switch 75' senses this condition and stops the rotation of the support member 20. At this time, the trailing end of the stored strip may be pulled upstream, past the inlet guide roller 66 into the welding zone 62, where the trailing end of the previously stored strip can be attached by welding or otherwise to the beginning end of a next succeeding strip. At this time, the drive for the support member 20 can again be commenced and a new package quickly transferred into the reservoir 38. This takes place with very little downtime, since the machine need only be stopped, with the arrangement shown in FIGS. 1–5, when the reservoir 38 is depleted and the trailing end must be welded to the next succeeding strip. The machine need not be stopped during a separate winding operation, since winding takes place simultaneously while the machine is being used to manufacture product.

It will be appreciated by those skilled in the art that the apparatus for storing and dispensing continuous materials overcomes the disadvantages of the prior art devices discussed in the background of the invention, including minimizing or eliminating down time due to rewinding of payoff devices. The apparatus also remains balanced throughout the entire storage and dispensing procedure, since the reservoir is concentrically arranged about the rotating axis of the machine. Therefore, balance is maintained irrespective of how much elongate material has been stored or dispensed. By providing tensioning devices to the stored convolutions in the reservoir, the apparatus maintains concentricity of stored loops or turns, avoids looseness of these with respect to each other and thereby avoids imbalance during rotation. This, in turn, assures good quality of the material being produced.

While the apparatus has been described in the environment of the specific machine, namely one for making helically wound interlocked flexible pipe, it will be appreciated that the same apparatus, with or without minor modifications, can be used in numerous other machines for manufacturing products which require the feeding of continuous elongate materials, such as flat strip material, including taping heads for applying tape to conductors.

Because the apparatus substantially eliminates all bends and twists of the elongate material, during the storage end dispensing phases, the apparatus is practical and usable with strip materials of various types, including large dimensioned stiff stainless steel strip material which other known machines cannot efficiently handle.

While exemplary embodiments of the invention have been shown and described, it will be recognized that this invention may be modified and practiced within the scope of the following claims.

I claim:

1. A continuously balanced apparatus for storing and dispensing elongate material for use with a rotating machine having a machine axis, the apparatus comprising:

a. a support member mounted for rotation about the machine axis;

b. drive means for rotating said support member;

c. inlet guide means for guiding elongate material from an external supply to said support member;

d. storage guide means mounted on said support member serving as a reservoir for storing elongate material as a single row of substantially circular overlapping convolutions concentrically arranged in relation to said machine axis;

e. outlet guide means mounted on said support member for guiding the innermost convolution of the stored elongate material radially inwardly of the support member proximate to said machine axis for being dispensed in a manufacturing operation;

f. tension means for maintaining tension on the elongate material; and g. sensing means for sensing when elongate material is about to be depleted from said reservoir storage guide means;

h. means actuated by said sensing means for deactivating said drive means and stopping rotation of said support member;

i. means for attaching, while said support member is stopped, a trailing end of a stored length of elongate material to a leading end of a new supply of elongate material; and j. means for reactivating said drive means for resuming rotation of said support member to wind said new supply of elongate material on said storage guide means.

2. An apparatus as defined in claim 1, wherein said support member comprises a rotating head in the form of a flat plate.

3. An apparatus as defined in claim 1, wherein said inlet guide means comprises an inlet guide roller mounted radially outwardly of said storage guide means and arranged to deflect incoming elongate material along a direction substantially tangential to a circular path defined by said storage guide means.

4. An apparatus as defined in claim 3, wherein said inlet guide roller is mounted on a pivoting arm to permit said inlet guide roller to abut against and substantially follow the outermost convolution stored in said reservoir.

5. An apparatus as defined in claim 1, wherein said storage guide means comprises a plurality of guide rollers spaced from each other about a circular path concentric with the machine axis.

6. An apparatus as defined in claim 1, wherein said outlet guide means comprises an outlet guide roller mounted on said support member radially inwardly of said storage guide means.

7. An apparatus as defined in claim 1, wherein said tension means comprises a strap arranged to contact the outermost convolution on said storage guide means substantially about the entire circumferential length thereof and further comprising length adjustment means for adjusting the length of said strap to compensate for different diameters of the outermost convolution.

8. An apparatus as defined in claim 7, wherein said strap comprises at least one rope.

9. An apparatus as defined in claim 7, wherein the elongate material is in the form of a flat strip, and said strap comprises a pair of ropes spaced from each other along a direction transverse to the length direction of said flat strip.

10. An apparatus as defined in claim 7, wherein said tension means further comprises tension enhancing means.

11. An apparatus as defined in claim 10, wherein one end of said strap is substantially fixed, and said tension enhancing means comprises pulling means for pulling the other end of said strap.

12. An apparatus as defined in claim 11, wherein said pulling means comprises a motorized tensioner which includes a pulley which engages at least a portion of the other end of said strap.

13. An apparatus as defined in claim 1, further comprising flange means mounted on said support member for rotation therewith for maintaining said circular overlapping convolutions in one row on said storage guide means.

14. An apparatus as defined in claim 3, wherein said flange means comprises two circular flanges spaced from each other on opposite sides of said storage guide means a distance substantially equal to the width of the elongate material.

15. An apparatus as defined in claim 1, further comprising lubricating means upstream of said inlet guide means for lubricating the elongate material prior to being placed on said storage guide means and wound as a series of overlapping convolutions.

16. An apparatus as defined in claim 13, wherein said tension means comprises a circular ring mounted on said flange means; a slidable shoe mounted on said circular ring for slidable movement along said circular ring; and gripping means for gripping and securing the end of a length of material to said slidable shoe, whereby a pulling and tensioning force is applied to the end of the elongate material when it is attached to said slidable shoe.

17. An apparatus as defined in claim 16, wherein said tension means comprises a retractable bar which bridges said flange means to be connectable to the end of the elongate material at the time that the trailing end of the elongate material is about to be wound onto said storage guide means, and said retractable bar is movable in relation to said flange means to clear the region of said flanges and to insure free winding of the elongate strip of material onto said storage guide means.

18. An apparatus as defined in claim 16, further comprising tension adjusting means for adjusting the tension between said circular ring and said slidable shoe.

19. An apparatus as defined in claim 1, in combination with a machine for producing interlocked flexible pipe.

20. An apparatus as defined in claim 1, further comprising payoff means upstream of said inlet guide means; and dancer means including dancer arm arranged to engage the wire being advanced and to apply tension to the elongate material.

21. An apparatus as defined in claim 1, wherein said tension means comprises a securing member attachable to the end of a length of material wound on said storage guide means, said securing member being rotatably mounted about the machine axis; and friction producing means between said securing member and said support member.

22. A method of storing and dispensing elongate material for use with a rotating machine having a machine axis, the method comprising the steps of:

a. guiding elongate material from an external supply to a rotating support member mounted for rotation about the machine axis;
b. storing elongate material as a single row of substantially circular overlapping convolutions concentrically arranged in relation to the machine axis on the support member to form a reservoir of elongate material;
c. guiding the innermost convolution of the stored material radially inwardly for being dispensed in a manufacturing operation;
d. maintaining tension on the elongate material;
e. sensing when the elongate material is about to be depleted from the reservoir;
f. stopping rotation of said support member responsive to said sensing of said elongate material;
g. attaching, while said support member is stopped, a trailing end of a stored length of said elongate material to a leading end of a new supply of elongate material; and
h. resuming rotation of said support member to wind said new supply of elongate material on said storage guide means.

* * * * *